US006368728B1

(12) United States Patent
Tobiyama et al.

(10) Patent No.: US 6,368,728 B1
(45) Date of Patent: Apr. 9, 2002

(54) GALVANNEALED STEEL SHEET AND MANUFACTURING METHOD

(75) Inventors: Yoichi Tobiyama; Chiaki Kato, both of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/437,671

(22) Filed: Nov. 10, 1999

(30) Foreign Application Priority Data

Nov. 18, 1998 (JP) ..... 10-328573

(51) Int. Cl.[7] ..... B32B 15/01; B32B 33/00

(52) U.S. Cl. ..... 428/659; 148/533; 148/534; 148/705; 427/433; 427/436; 427/349; 428/687

(58) Field of Search ..... 428/659, 687; 427/433, 436, 349; 148/533, 534, 705

(56) References Cited

U.S. PATENT DOCUMENTS 5,409,553 A * 4/1995 Sagiyama et al. ..... 428/659

FOREIGN PATENT DOCUMENTS

| | | | | |
|---|---|---|---|---|
| EP | 540 005 | A1 | 10/1992 | |
| EP | 657 561 | A1 | 6/1994 | |
| JP | 07026360 | | 1/1995 | |
| JP | 07216526 | | 8/1995 | |
| JP | 08092714 | | 4/1996 | |
| JP | 08-092714 | A1 * | 4/1996 | ..... C23C/2/06 |
| JP | 08269665 | | 10/1996 | |
| JP | 09078214 | | 3/1997 | |
| JP | 09165662 | | 6/1997 | |
| JP | 10130804 | | 5/1998 | |
| JP | 10-226862 | A1 * | 8/1998 | ..... C23C/2/06 |
| JP | 10226862 | | 8/1998 | |

* cited by examiner

*Primary Examiner*—Robert R. Koehler
(74) *Attorney, Agent, or Firm*—Schnader Harrison Segal & Lewis LLP

(57) ABSTRACT

Galvannealed steel sheet and method, made by applying hot-dip galvanizing to a steel sheet, heating at a heating rate of at least about 10° C./second to a maximum sheet temperature within a range of from about 470 to 550° C., and applying an alloying treatment; the Al content $X_{Al}$% in the hot-dip galvannealing layer and the coating weight W g/m$^2$ satisfy the following equation (1); thereby producing a Zn—Fe galvannealing layer having an iron content of from about 7 to 12%; the galvannealed steel sheet has intensities of ζ-phase, δ1-phase and Γ-phase that satisfy the following equations (4) and (5) as observed through X-ray diffraction with the galvannealing layer peeled off the galvannealed steel sheet at the galvannealing/steel sheet interface, and the galvannealed steel sheet having excellent press workability, having a whiteness and a glossiness within prescribed ranges:

$$5 \leqq W \times (X_{Al} - 0.12) \leqq 15 \quad (1)$$

$$I(\zeta:1.26)/I(\delta1:2.13) \leqq 0.02 \quad (4)$$

$$I(\Gamma:2.59)/I(\delta1:2.13) \leqq 0.1 \quad (5).$$

6 Claims, 2 Drawing Sheets

○, ☆, △, □, ▽ : CHEMICAL COMPOSITION OF SAMPLE (BEFORE HEATING)

●, ★, ▲, ■, ▼ : PHASE STRUCTURE (COMPOSITIONS) OF A PLURALITY OF KINDS APPEARING IN RESPONSE TO THE INDIVIDUAL SAMPLES AFTER HEATING TO 450 °C

GALVANNEALED STEEL SHEET AND MANUFACTURING METHOD

BACKGROUND OF THE INVENTION

1. Field of the Invention

The present invention relates to manufacturing galvannealed steel sheet used as an automobile rust-preventive steel sheet, and a galvannealed steel sheet.

2. Description of the Related Art

Zinc-based hot-dip plating and electroplating have been developed and industrialized to produce automobile rust-preventive steel sheets having excellent sacrificial anticorrosion ability. Particularly, galvannealed steel sheets are popularly employed as automotive steel sheets because of low manufacturing cost and high corrosion resistance.

The galvannealed steel sheet is a surface treated steel sheet of low cost and high corrosion resistance. When used as an automobile rust-preventive steel sheet, however, a problem in workability in press forming has been pointed out as compared with electrogalvanized steel sheets, because of the fact that the plating layer itself is composed from a Zn—Fe-based intermetallic compound produced through mutual diffusion of the substrate metal and pure zinc, and many studies have been made to improve press-formability of the galvannealed steel sheet.

Problems are encountered in actual press forming of the galvannealed steel sheet.

One is a phenomenon known as powdering in which the galvannealing layer is peeled off into powder during working. A Γ-phase, if produced in a large quantity on the galvannealing/steel sheet interface, causes deterioration of powdering resistance and press-workability. A galvannealed steel sheet having excellent powdering resistance is therefore demanded.

Another property to be satisfied during press working is associated with the condition of the surface galvanizing layer such as friction with a die.

These properties largely depend upon the phase structure of the surface of galvannealing layer, and the presence of a soft and low-melting-point ζ-phase as compared with a δ1-phase causes serious deterioration of properties.

A galvannealed steel sheet having good press-workability is a steel sheet satisfying both powdering resistance and low coefficient of friction. For this purpose, a galvannealing phase mainly comprising a δ1-phase achievable by inhibiting the Γ-phase and the ζ-phase would be an ideal galvannealing phase.

Conventionally available methods for manufacturing a galvannealed steel sheet having satisfactory powdering resistance and low coefficient of friction, in which the phase structure is properly controlled, include controlling the Al concentration in the galvanizing bath, and a method of controlling generation of excessive Γ-phase and ζ-phase by setting forth the degree of alloying of the galvannealing layer.

Regarding alloying conditions applied when manufacturing a galvannealed steel sheet, on the other hand, effectiveness of regulating the alloying temperature has been reported.

When trying to obtain a galvannealed steel sheet mainly comprising a δ1-phase through the usual process, it is difficult to obtain a targeted galvannealing phase structure by only regulating simply an alloying temperature. It is necessary to satisfy other requirements for a strict control of the galvannealing phase structure.

Some techniques have been introduced to date in view of the heating rate upon alloying as a factor.

For example, Japanese Unexamined Patent Publication No. 4-48061 discloses a technique comprising the steps of conducting alloying at a heating rate of at least 30° C./second to a temperature within a range of from 470 530° C., and regulating the relationship between the coating weight and the iron content in the plating layer, thereby improving press-formability.

Japanese Unexamined Patent Publication No. 1-279738 discloses obtaining a plating having excellent powdering resistance and flaking resistance by limiting the Al concentration in the plating bath within a range of from 0.04 to 0.12 wt. %, reaching an alloying temperature of at least 470° C. in two seconds after the completion of the coating weight control, and rapidly cooling the plated sheet to a temperature of 420° C. or less in two seconds after completion of alloying.

Japanese Unexamined Patent Publication No. 7-34213 discloses a technique of improving interface adhesion by using an Al concentration in the bath within a range of from 0.105 to 0.3 wt. %, subjecting the sheet to hot-dip galvanizing, then heating the same at a rate of at least 20° C./second, performing alloying at a temperature within a range of from 420 to 650° C., and heating the sheet at a temperature of from 450 to 550° C. for a period of at least three seconds.

In order to manufacture a galvannealed steel sheet having excellent press-workability, as described above, the phase structure of the galvannealing layer must mainly comprise a δ1-phase. An object of the invention, as described later, is to inhibit generation of the ζ-phase and the Γ-phase.

In this respect, the conventional art disclosed in the aforementioned Japanese Unexamined Patent Publication No. 4-48061 of improving press formability by heating the sheet at a heating rate of at least 30° C./second, and regulating the relationship between the coating weight and the iron content in the plating layer inhibits generation of the ζ-phase and the Γ-phase to some extent, but press formability cannot be improved to a sufficient level by this means alone. A galvannealed steel sheet cannot be manufactured containing reduced ζ and Γ phases unless a sufficient amount of Al is kept in the galvanizing layer.

While Japanese Unexamined 4-48061 sets forth the relationship between the coating weight (W g/m$^2$) and the iron content in the galvannealing layer ($C_{Fe}$ wt. %) by making $18-(W/10) \geqq C_{Fe} \geqq 9$, an increase in the coating weight in this case leads to a narrow range of iron content in the galvannealing layer to be controlled, resulting in a problem of difficult operation.

The above-mentioned Japanese Unexamined Patent Publications Nos. 1-279738 and 7-34213 set forth the Al concentration in the galvanizing bath in addition to the alloying conditions.

However, when trying to ideally control the phase structure of plating, as described later, simple regulation of constituent concentrations in the plating bath is not sufficient. The conventional techniques described do not achieve the target of inhibiting generation of the Γ-phase and the ζ-phase significantly.

SUMMARY OF THE INVENTION

The present invention provides a manufacturing method for a galvannealed steel sheet, comprising the steps of subjecting a steel sheet to hot-dip galvanizing, then heating the sheet at a heating rate of at least about 10° C./second to a maximum sheet temperature within a range of from about 470 to 550° C., subjecting the sheet to an alloying treatment at a temperature of up to the maximum sheet temperature, controlling the Al content expressed as $X_{Al}$% of the galvannealing layer and the coating weight expressed as W g/m$^2$ to satisfy substantially the following equation (1), and obtaining a Zn—Fe galvannealing layer having an iron content of from about 7 to 12%; a galvannealed steel sheet having intensity of a prescribed interplanar spacing of ζ-phase, δ1-phase and Γ-phase as determined through X-ray diffraction applied to the galvannealing layer by peeling off the galvannealing layer at the galvannealing/steel sheet interface, substantially satisfying the following equations (4) and (5); and a galvannealed steel sheet excellent press workability, having a whiteness and glossiness substantially within the prescribed ranges:

$$5 \leqq W \times (X_{Al} - 0.12) \leqq 15 \quad (1)$$

$$I(\zeta:1.26)/I(\delta1:2.13 \leqq 0.02 \quad (4)$$

$$I(\Gamma:2.59)/I(\delta1:2.13) \leqq 0.1 \quad (5)$$

DESCRIPTION OF THE PREFERRED EMBODIMENT

Figure 1:
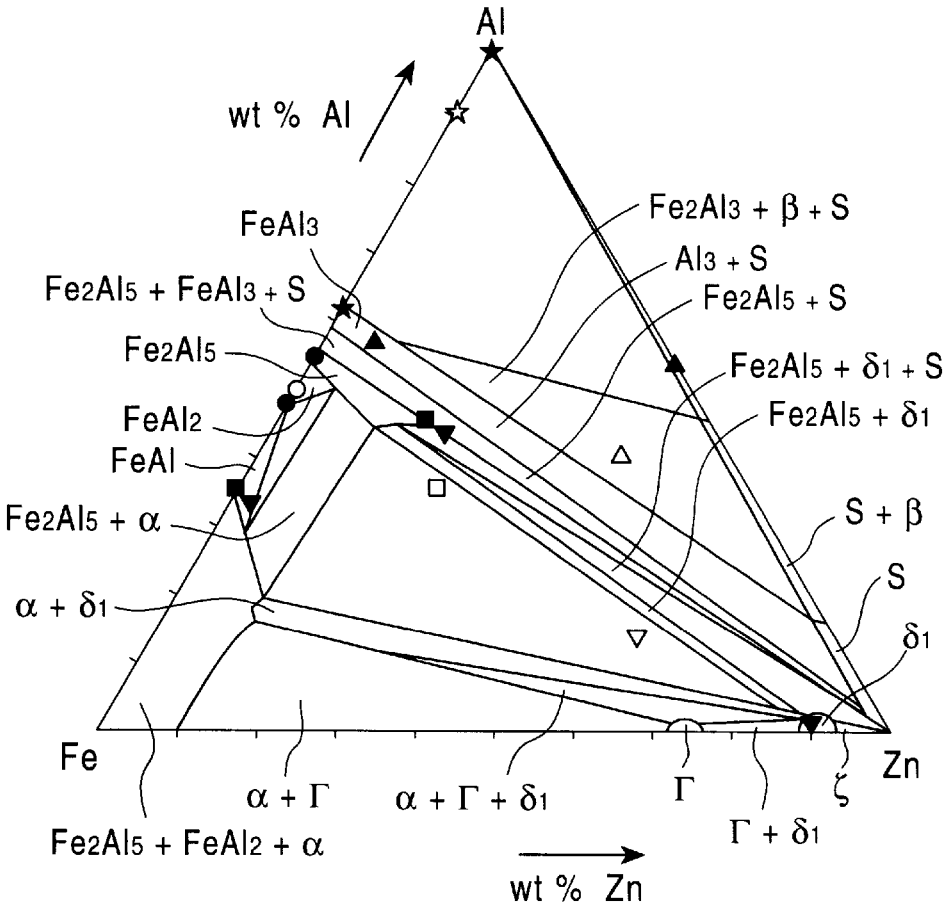
FIG. 1 is a graph illustrating a Zn—Fe—Al tertiary equilibrium phase diagram.

The present invention has an object to provide a method of manufacturing a galvannealed steel sheet having excellent press workability, and to provide a superior galvannealed steel sheet.

We have found that, in order to manufacture a galvannealed steel sheet having excellent press workability, it is important to use not only a controlled alloying temperature but also a controlled heating rate in the alloying step, and also by conducting alloying while maintaining Al present in a sufficient quantity in the galvannealing layer. This makes it possible to create a galvannealed steel sheet that has excellent press workability.

In order to ensure a sufficient quantity of Al in the galvanizing layer, it is necessary to control the component concentrations of the galvanizing bath, as well as the oxygen concentration and the dew point of the atmosphere in the annealing furnace, the concentration and the dew point of the atmosphere extending from the annealing furnace to the galvanizing bath, and the relationship between the temperature of the sheet coming into the galvanizing bath and the bath temperature. After setting forth these factors and ensuring a controlled Al content in the galvanizing layer, it is possible to manufacture a galvannealed steel sheet having excellent powdering resistance and low coefficient of friction, by using a highly controlled heating rate, use of a maximum sheet temperature or less for alloying, and an optimum maximum sheet temperature.

We have found that it is possible to manufacture a galvannealed steel sheet having further excellent press workability by subjecting the galvannealed steel sheet, manufactured under the aforementioned atmospheric gas conditions for the portion of the process extending from the annealing furnace to the hot-dip galvanizing bath, the hot-dip galvanizing conditions and the heating-alloying conditions, to perform temper rolling through rolling mill rolls provided with a controlled surface roughness, and controlled glossiness and whiteness of the galvannealed steel sheet within controlled ranges.

An important feature of the present invention relates to a manufacturing method of a galvannealed steel sheet having excellent press workability, comprising the steps of applying hot-dip galvanizing to a steel sheet; then subjecting the steel sheet to gas wiping for control of the coating weight; heating the steel sheet, after completion of gas wiping, at a heating rate of at least about 10 (° C./second) to a maximum sheet temperature within a range of from about 470 to 550° C.; and then, applying a galvannealing treatment at a maximum sheet temperature or less; thereby obtaining a Zn—Fe galvannealing layer, with an Al content $X_{Al}$ (%: weight percentage) of the galvannealing layer and the coating weight of the galvannealed steel sheet: W (g/M$^2$) substantially satisfying the following equation (1), and with an iron content in the galvannealing layer within a range of from about 7 to 12 (%: weight percentage):

$$5 \leqq W \times (X_{Al} - 0.12) \leqq 15 \quad (1)$$

In the aforementioned method, the total Al concentration: $N_{Al}$ (%: weight percentage) and the total iron concentration: $N_{Fe}$ (%: weight percentage) in the galvanizing bath upon hot-dip galvanizing should preferably substantially satisfy the following equation (2), and the incoming sheet temperature into the galvanizing bath: t (° C.) and the galvanizing bath temperature: T (° C.) should preferably substantially satisfy the following equation (3) (first preferred embodiment of the first aspect of the invention):

$$0.08 \leqq N_{Al} - N_{Fe} \leqq 0.12 \quad (2)$$

$$0 \leqq t - T \leqq 50 \quad (3)$$

In the aforementioned method, the atmosphere gas in the steel sheet passing section from the annealing furnace to the galvanizing bath during the step before hot-dip galvanizing in the annealing furnace should preferably have an oxygen concentration of up to about 50 vol.ppm (volume percentage) and a dew point of about −20° C. or less.

In the aforementioned method, a temper rolling should preferably be carried out after the galvannealing treatment, with rolls (work rolls) having a surface roughness: Ra of at least about 0.5 μm.

A further feature of the invention relates to a galvannealed steel sheet having excellent press workability, wherein, after a galvannealing layer of a galvannealed steel sheet is peeled off at a galvannealing layer/steel sheet interface, and the intensity of ζ-phase, δ1-phase and Γ-phase of the peeled galvannealing layer is observed through X-ray diffraction from the interface, substantially satisfies the following equations (4) and (5):

$$I(\zeta:1.26)/I(\delta1:2.13) \leqq 0.02 \quad (4)$$

$$I(\Gamma:2.59)/I(\delta1:2.13) \leqq 0.1 \quad (5)$$

where, I(ζ:1.26) represents intensity of ζ-phase, interplanar spacing d=1.26 Å; I(δ1:2.13) represents intensity of δ1-phase, interplanar spacing d=2.13 Å; and I(Γ:2.59) represents, intensity of Γ-phase interplanar spacing d=2.59 Å.

In this further feature of the invention, the galvannealed steel sheet should preferably have a coating weight: W of within a range of from about 10 to 100 g/m$^2$, an iron content in the galvannealing layer of within a range of from about 7 to 12% (weight percentage), and an Al content in the galvannealing layer: $X_{Al}$ (%: weight percentage) and a coating weight: W (g/m$^2$) substantially satisfying the following equation (1):

$$5 \leqq W \times (X_{Al} - 0.12) \leqq 15 \quad (1)$$

Preferred Embodiment

Still another feature of the invention relates to a galvannealed steel sheet having excellent press workability, wherein the galvannealed steel sheet has a whiteness: L-value as measured by the method specified in JIS Z8722 (condition d, with light trap) of about 70 or less, and a glossiness as measured by the method specified in JIS Z8741 (60° specular gloss method) of about 30 or less.

A more preferred embodiment relates to a galvannealed steel sheet having a whiteness: L-value as measured by the method specified in JIS Z8722 (condition d, with light trap) of about 70 or less, and a glossiness as measured by the method specified in JIS Z8741 (60° specular gloss method) of about 30 or less, wherein a galvannealing layer of a galvannealed steel sheet is peeled off at a galvannealing layer/steel sheet interface, and intensities of ζ-phase, δ1-phase and Γ-phase of the peeled galvannealing layer are observed through X-ray diffraction from the interface and substantially satisfy the following equations (4) and (5):

$$I(\zeta{:}1.26)/I(\delta 1{:}2.13) \leqq 0.02 \quad (4)$$

$$I(\Gamma{:}2.59)/I(\delta 1{:}2.13) \leqq 0.1 \quad (5)$$

where I(ζ:1.26) represents the intensity of ζ-phase, interplanar spacing d=1.26 Å; I(δ1:2.13), the intensity of δ1-phase, interplanar spacing d=2.13 Å; and I(Γ:2.59), an intensity of Γ-phase, interplanar spacing d=2.59 Å.

A more preferred embodiment relates to a galvannealed steel sheet having excellent press workability having a whiteness: L-value as measured by the method specified in JIS 8722 (condition d, with light trap) of about 70 or less, and a glossiness as measured by the method specified in JIS Z8741 (60° specular gloss method) of about 30 or less; wherein the galvannealed steel sheet has a coating weight: W within a range of from about 10 to 100 g/m$^2$, and an iron content in the galvannealing layer within a range of from about 7 to 12% (weight percentage) and an Al content in the galvannealing layer: $X_{Al}$ (%: weight percentage) and a coating weight: W (g/m$^2$) substantially satisfying the following equation (1); and wherein a galvannealing layer of a galvannealed steel sheet is peeled off at a galvannealing layer/steel sheet interface, and intensities of ζ-phase, δ1-phase and Γ-phase of the peeled galvannealing layer when observed through X-ray diffraction form the interface, substantially satisfies the following equations (1), (4) and (5):

$$5 \leqq W \times (X_{Al} - 0.12) \leqq 15 \quad (1)$$

$$I(\zeta{:}1.26)/I(\delta 1{:}2.13) \leqq 0.02 \quad (4)$$

$$I(\Gamma{:}2.59)/I(\delta 1{:}2.13) \leqq 0.1 \quad (5)$$

where I(ζ:1.26) represents intensity of ζ-phase, interplanar spacing d=1.26 Å; I(δ1:2.13), intensity of δ1-phase, interplanar spacing d=2.13 Å; and I(Γ:2.59), intensity of Γ-phase, interplanar spacing d=2.59 Å.

The Al content: $X_{Al}$ and the iron content in the galvannealing layer in the invention, represent the average Al content and the average iron content in the galvannealing layer.

The present invention will now be described in further detail.

The first mentioned feature of the present invention relates to a manufacturing method of a galvannealed steel sheet having excellent press workability, comprising the step of applying hot-dip galvannealing to a steel sheet; then subjecting the steel sheet to gas wiping; heating the steel sheet, after completion of the gas wiping, at a heating rate of at least about 10 (° C./second) to a maximum sheet temperature within a range of from about 470 to 550° C.; and then, applying a galvannealing treatment at the temperature of the maximum sheet temperature or less; thereby obtaining a Zn—Fe galvannealing layer, with the Al content: XAl (%: weight percentage) of the galvannealing layer and the coating weight of the galvannealed steel sheet: W (g/m$^2$) substantially satisfying the following equation (1), and with an iron content in the galvannealing layer substantially within a range of from about 7 to 12 (%: weight percentage):

$$5 \leqq W \times (X_{Al} - 0.12) \leqq 15 \quad (1)$$

A preferred embodiment relates to a manufacturing method of a galvannealed steel sheet having excellent press workability, wherein the total Al concentration: $N_{Al}$ (%: weight percentage) and the total iron concentration: $N_{Fe}$ (%: weight percentage) in the galvannealing bath upon hot-dip galvannealing substantially satisfies the following equation (2), and the incoming sheet temperature into the galvannealing bath: t (° C.) and the galvannealing bath temperature: T (° C.) substantially satisfies the following equation (3):

$$0.08 \leqq N_{Al} - N_{Fe} \leqq 0.12 \quad (2)$$

$$0 \leqq t - T \leqq 50 \quad (3)$$

Another preferred embodiment of the aforementioned preferred embodiment of the invention, wherein the atmosphere gas in the steel sheet passing section from the annealing furnace to the galvannealing bath during the step before hot-dip galvannealing in the annealing furnace and has an oxygen concentration of about 50 vol.ppm or less (volume percentage) and a dew point of −20° C. or less.

The aforementioned preferred embodiment relates to a galvannealed steel sheet having excellent press workability, wherein a galvannealing layer of a galvannealed steel sheet is peeled off at a galvannealing layer/steel sheet interface, and the intensities of the ζ-phase, the δ1-phase and the Γ-phase of the peeled galvannealing layer observed through X-ray diffraction from the interface substantially satisfies the following equations (4) and (5):

$$I(\zeta{:}1.26)/I(\delta 1{:}2.13) \leqq 0.02 \quad (4)$$

$$I(\Gamma{:}2.59)/I(\delta 1{:}2.13) \leqq 0.1 \quad (5)$$

where I(ζ:1.26) represents the intensity of ζ-phase, interplanar spacing d=1.26 Å; I(δ1:2.13) represents intensity of the δ1-phase, interplanar spacing d=2.13 Å; and I(Γ:2.59) represents intensity of the Γ-phase, interplanar spacing d=2.59 Å.

The preferred embodiment of the aforementioned second aspect of the invention relates to a galvannealed steel sheet excellent in press workability, wherein the galvannealed steel sheet has a coating weight W within a range of from about 10 to 100 g/m$^2$, an iron content in the galvannealing layer within a range of from about 7 to 12% (weight percentage), and an Al content in the galvannealing layer of $X_{Al}$ (%: weight percentage) and a coating weight: W (g/m$^2$) which substantially satisfy the following equation (1):

$$5 \leqq W \times (X_{Al} - 0.12) \leqq 15 \quad (1)$$

The Al content: $X_{Al}$ and the iron content in the galvannealing layer in the preferred embodiments of the invention represent the average Al content and the average iron content in the galvannealing layer, respectively.

As described above, the present invention provides a galvannealed steel sheet and method mainly comprising the δ1-phase in which the generation of the Γ-phase and the ζ-phase is inhibited as much as possible. An outline comprises the following points (1) to (3).

(1) Maintain Al in a prescribed amount to the galvanizing layer upon heating-alloying of a hot-dip galvanized steel sheet;

(2) Setting forth, in order to maintain Al in a sufficient amount in the galvannealing layer, not only the constituent concentrations of the galvanizing bath, but also the atmosphere in the annealing furnace, the atmosphere in the steel sheet passing section during the process from the annealing furnace to galvanizing bath, and the relationship between the incoming temperature of steel sheet into the galvanizing bath and the bath temperature; and (3) Upon heating-alloying the hot-dip galvanized steel sheet, heating the steel sheet at a high heating rate to a maximum sheet temperature within a controlled range, and alloying the sheet so that the galvannealing layer has an iron content within a range of from about 7 to 12% through control of the alloying time.

That is, it is important to alloy the sheet by rapidly heating it to the maximum sheet temperature after incorporating Al in a controlled amount into the galvanizing layer under the above-mentioned prescribed conditions. Only this way is it possible to obtain a galvannealing layer in which generation of the Γ-phase and ζ-phase product is successfully inhibited.

Necessary requirements will now be described in detail.

First, in order to inhibit generation of the ζ-phase, it is necessary to keep the Al present in a sufficient amount in the galvanizing layer, as is clear from the Zn—Fe—Al tertiary equilibrium phase diagram shown in FIG. 1 (Urednicek, Kirkaldy).

More specifically, the ζ-phase cannot thermodynamically exist unless the Al concentration in the molten zinc in contact with the galvanizing layer during alloying is reduced. In other words, generation of the ζ-phase can be inhibited if the Al concentration in the molten zinc is kept above a certain level as set forth herein.

The present inventors carried out various research efforts regarding the Al content in the galvanizing layer necessary for inhibiting generation of the ζ-phase, and as a result, discovered how to largely inhibit generation of the ζ-phase by causing the Al content (average Al content) in the galvannealing layer: $X_{Al}$ (%) and the coating weight: W (g/m$^2$) to substantially satisfy the following equation (6), and appropriately selecting the subsequent alloying conditions:

$$5 \leqq W \times (X_{Al} - 0.12) \quad (6)$$

Regarding inhibition of the Γ-phase, to judge from the phase diagram shown in FIG. 1, the Γ-phase cannot exist when iron-aluminum intermetallic compounds produced on the interface between the substrate steel sheet and the galvanizing layer are present during hot-dip galvanizing, while the Γ-phase is generated at a stage when the iron-aluminum intermetallic compounds disappear in the alloying process.

For the purpose of inhibiting generation of the Γ-phase, therefore, it is necessary to maintain Al present in a sufficient amount in the galvanizing layer, as in the aforementioned case, to retain the above-mentioned iron-aluminum intermetallic compounds in a sufficient amount.

As a result of study on the necessary amount thereof, we have discovered a way of sufficiently inhibiting generation of the Γ-phase within a controlled range of Al content, permitting inhibition of generation of the ζ-phase as described above.

More particularly, it is possible to inhibit generation of the Γ-phase and the ζ-phase by causing the amount of Al incorporated into the galvannealing layer to substantially satisfy the above equation (6) relative to the coating weight W and the Al content $X_{Al}$, and then appropriately applying conditions for subsequent alloying.

A large amount of Al in the galvanizing layer leads, on the other hand, to a lower alloying rate; Al in an amount exceeding the limit causes a delay in alloying and results in a decrease in productivity.

A low alloying rate makes it essentially difficult for the effect of high-rate heating as described below to express, and this is disadvantageous also in terms of phase structure control.

We have carried out many studies to determine the upper limit of Al content in the galvannealing layer. We have discovered a way to solve the above problems by causing the Al content (average Al content) in the galvannealing layer $X_{Al}$ (%) and the coating weight W (g/m$^2$) to substantially satisfy the following equation (7):

$$W \times (X_{Al} - 0.12) \leqq 15 \quad (7)$$

In order to achieve strict control over the phase structure of the galvannealing layer, as described above, it is an important requirement to maintain a certain Al content in the galvannealing layer, and the Al content (average Al content) in the galvannealing layer $X_{Al}$ (%) and the coating weight W (g/m$^2$) of the galvannealed steel sheet must substantially satisfy the following equation (1):

$$5 \leqq W \times (X_{Al} - 0.12) \leqq 15 \quad (1)$$

Conditions necessary for satisfying the above equation (1) are as described in paragraphs [1] to [3] which follow:

[1] Galvanizing Bath Constituent Concentrations

In order to ensure the presence of Al in a certain amount in the galvannealing layer, the operation must be carried out within a range of galvanizing bath constituent concentrations in which the total Al concentration $N_{Al}$ (%) and the total iron concentration $N_{Fe}$ (%) in the galvanizing bath during hot-dip galvanizing substantially satisfy the following equation (2):

$$0.08 \leqq N_{Al} - N_{Fe} \leqq 0.12 \quad (2)$$

The bath concentrations are defined with the difference between the total Al concentration $N_{Al}$ and the total iron concentration $N_{Fe}$ for the following reason.

Iron-aluminum intermetallic compounds are present in a solid-solution state in the galvanizing bath under the effect of iron inevitably dissolved from the steel sheet, and the amount of Al dissolved in molten zinc is smaller than the total Al content. An actual amount of dissolved Al can therefore be approximately determined by means of the value of $(N_{Al} - N_{Fe})$.

With a value of $(N_{Al} - N_{Fe})$ of under about 0.08%, the amount of Al incorporated in the galvanizing layer is insufficient. When the value of $(N_{Al} - N_{Fe})$ is over about 0.12%, on the other hand, the alloying rate becomes lower as described above, thus making it difficult for the effect of high-rate heating in the invention to express.

An unnecessary increase in the Al content in the bath causes generation of dross from iron-aluminum intermetallic compounds in a large quantity, resulting in a surface quality problem of adhesion of dross to the steel sheet.

On the other hand, we studied maintenance of Al in the galvanizing layer, and found that a controlled Al concentration in the bath did not permit incorporation of Al in an amount allowing control over the phase structure during alloying into the galvannealing layer.

[2] Bath Temperature During Galvanizing and Incoming Sheet Temperature:

In order to maintain an Al content in the galvannealing layer at least on a certain level, it is necessary to satisfy the following conditions, in addition to the bath chemical composition.

First, the relationship of the following equation (3) must be substantially applicable between the bath temperature T (° C.) during galvanizing and the incoming temperature of the steel sheet into the galvanizing bath t (° C.).

$$0 \leqq t-T \leqq 50 \quad (3)$$

The reason is as follows.

For the purpose of incorporating Al in a sufficient amount into the galvanizing layer, the dissolved Al concentration in molten zinc must be sufficiently high near the steel sheet during galvanizing.

However, if the temperature of the incoming steel sheet is lower than the galvanizing bath temperature, a decrease in the bath temperature near the steel sheet causes further crystallization of iron-aluminum intermetallic compounds, because the galvanizing bath is over-saturated with iron-aluminum intermetallic compounds, and a decrease in the dissolved Al concentration near the steel sheet.

As a result, the amount of Al incorporated effectively into the hot-dip galvanizing layer decreases, thus making it impossible to maintain Al in the controlled amount in the galvanizing layer. In order to do so, as an essential requirement in the invention, the incoming sheet temperature must be at least equal to the bath temperature.

A value of t−T of about 50° C. or less is important because, when the incoming sheet temperature t (° C.) becomes higher than the bath temperature T (° C.) by more than 50° C., the bath temperature increases during the continuous galvanizing operation, thus making it difficult to keep a constant bath temperature, and it becomes necessary to cool the bath for maintaining a constant bath temperature, causing operational problems.

[3] Condition of Steel Sheet Incoming into the Galvanizing Bath is Important.

When the steel sheet enters the galvanizing bath with an oxidized surface layer, dissolved Al in the bath is consumed by reduction of oxides on the steel sheet surface. A decrease occurs in the effective dissolved Al concentration in the bath near the steel sheet, and it becomes difficult to maintain Al in the galvanizing layer in the controlled amount.

It is therefore necessary to avoid oxidation of the steel sheet as much as possible in the annealing step applied prior to galvanizing and subsequent steps.

In the present invention, therefore, oxidation of the steel sheet is prevented as far as possible by maintaining an oxygen concentration of about 50 vol.ppm or less and a dew point of about −20° C. or less, not only for the atmosphere gas in the annealing furnace, but also for the atmosphere gas in the steel sheet passing section in the process from the annealing furnace to the galvanizing bath; Al in a controlled amount is incorporated into the galvanizing bath.

In the invention, no particular limitation is imposed on the lower limits of the oxygen concentration and the dew point of the atmosphere in the annealing furnace and the atmosphere in the steel sheet passing section in the process from the annealing furnace to the galvanizing bath. From the industrial application and economic point of view, however, the oxygen concentration in the atmosphere gas should preferably be at least about 1 vol.ppm, and the dew point, at least about −60° C.

The term "in the steel sheet passing section in the process from the annealing furnace to the galvanizing bath" as mentioned above means "in the steel sheet passing section and the snout in the process from the annealing furnace to the snout, i.e., in the steel sheet passing section in the process from the annealing furnace to the galvanizing bath.

In order to maintain Al in a sufficient amount in the galvannealing layer during alloying, which is an important requirement for strict control of the phase structure of the galvannealing layer of the galvannealed steel sheet, setting of a lower limit for the Al content in the bath described in [1] above is not sufficient, and it is essential to satisfy the requirements mentioned in [2] and [3] above disclosed in the invention.

Alloying conditions for heating-alloying in the invention will now be described.

In the present invention, it is a prerequisite that the maximum reachable sheet temperature is within the range of from about 470 to 550° C. The maximum sheet temperature should preferably be within a range of from about 470 to 520° C., or more preferably, from about 480 to 520° C.

When the maximum sheet temperature is not within the aforementioned range of temperature, it is difficult to manufacture a galvannealed steel sheet having a target phase structure even if the heating rate described later, and other alloying conditions, are changed.

More specifically, a maximum sheet temperature of under about 470° C. leads to shifting toward formation of the ζ-phase in the galvannealing surface layer.

Further, easier generation of the ζ-phase results in easier generation of the Γ-phase on the interface between the galvannealing layer and the substrate.

When the ζ-phase is present on the Zn—Fe alloy layer surface, the lower solid-solution limit of iron inhibits diffusion of iron from the substrate as compared with the presence of the single δ1-phase. This results in an increase in the iron content in the interface, thus facilitating generation of the Γ-phase.

In order to inhibit generation of both the Γ-phase and the ζ-phase, therefore, it is necessary to limit the lower limit of the maximum sheet temperature to about 470° C.

When the maximum sheet temperature is over about 550° C., the Γ-phase is more likely to be produced. The maximum sheet temperature should not therefore exceed about 550° C.

As described above, alloying must be accomplished at a maximum sheet temperature within a range of from about 470 to 550° C., or preferably, from about 470 to 520° C., or more preferably, from about 480 to 520° C.

After reaching the maximum sheet temperature during alloying, alloying should be continued at the maximum sheet temperature or less.

The maximum sheet temperature is determined with a view to inhibiting generation of the Γ-phase and the ζ-phase as much as possible. When alloying is continued at a temperature higher than the initially reached sheet temperature, this would be alloying on the higher temperature side on which the Γ-phase is easily generated, thus tending toward generation of the Γ-phase.

Control of the iron content in the galvannealing layer is very important for the inhibition of generation of the Γ-phase, and it is necessary to control the iron content in the galvannealing layer after manufacture of the galvannealed steel sheet within a range of from about 7 to 12%.

An iron content under about 7% in the galvannealing layer after heating-alloying causes unalloyed ζ-phase to be present in the galvanizing surface layer, and exerts an adverse effect on corrosion resistance, coating film adhesion and other properties.

When the iron content in the galvannealing layer after heating-alloying is over about 12%, in contrast, the Γ-phase is produced on the galvannealing/steel sheet interface in a large quantity, thus making it difficult to achieve a satisfactory powdering resistance.

In order to manufacture a galvannealed steel sheet having excellent powdering resistance, therefore, it is necessary to bring the iron content in the galvannealing layer after heating-alloying within the above-mentioned range through careful control of the alloying period.

Further in the invention, the heating rate during alloying is kept to at least a certain value and high-rate heating is carried out for control of the phase structure of the galvannealing layer.

In other words, after the completion of gas wiping carried out to control the coating weight following hot-dip galvanizing, a heating rate of at least about 10° C./second to the maximum sheet temperature, or more preferably, at least about 20° C./second during alloying is used for alloying.

The reason is as follows.

When the heating rate in alloying is low, the time provided in the low-temperature region of under about 470° C. causes generation of the ζ-phase. When the time becomes longer, this affords easier generation of the ζ-phase.

When alloying proceeds with the heating rate low and the ζ-phase is present, the presence of the ζ-phase on the Zn—Fe alloy layer surface inhibits diffusion of iron from the substrate, as compared with the case of the single δ1-phase. Because of the low level of solid-solution of the ζ-phase, this results in an increase in the iron content at the interface between the galvannealing layer and the substrate. This results in easier production of the Γ-phase in the galvannealing/steel sheet interface.

For the purpose of inhibiting generating of the Γ-phase and the ζ-phase, therefore, control of the heating rate is also an important requirement, apart from maintenance of the Al content in the galvannealing layer and the maintenance of an appropriate maximum sheet temperature as described above.

Applicable means for achieving a heating rate of at least about 10° C./second include gas heating and induction heating.

In the invention, no limitation is imposed on the means so far as a heating rate of at least about 10° C./second, or more preferably, at least about 20° C./second is ensured.

In the invention, the aforementioned heating rate to the maximum sheet temperature during alloying should preferably be about 100° C./second or less.

When the heating rate to the maximum sheet temperature during alloying is over about 100° C./second, the effect of increase in the heating rate is practically saturated, and this is economically disadvantageous.

While the invention sets forth the maximum sheet temperature and the heating rate of the steel sheet after maintaining Al in a sufficient amount in the galvannealing layer, the invention does not impose a particular prescription on these factors so far as an alloying temperature lower than the maximum sheet temperature is kept until the completion of alloying, if the time point of disappearance of the η-phase of galvanizing is defined as the completion of alloying.

This is also the case with the period until the completion of alloying, i.e., the alloying period.

Any heat pattern may therefore be used so far as the aforementioned requirements are satisfied.

The phase structure of the galvannealing layer of the galvannealed steel sheet available in the present invention is such that the following equations (4) and (5) are substantially satisfied by the intensity of ζ-phase, δ1-phase and Γ-phase as observed through an X-ray diffraction from the interface side for the galvannealing layer peeled off from the galvannealing/steel sheet interface preferably by a method described later in Examples:

$$I(\zeta:1.26)/I(\delta1:2.13) \leqq 0.02 \quad (4)$$

$$I(\Gamma:2.59)/I(\delta1:2.13) \leqq 0.1 \quad (5)$$

where,

I(ζ:1.26) is intensity of interplanar spacing d=1.26 Å of ζ-phase;

I(δ1:2.13) is intensity of interplanar spacing d=2.13 Å of δ1-phase;

I(Γ:2.59) is intensity of interplanar spacing d=2.59 Å of Γ-phase.

Further, the galvannealing layer of the galvannealed steel sheet available in the invention should preferably have a phase structure in which intensity of ζ-phase, δ1-phase and δ-phase substantially satisfy the following equations (8) and (9) in an X-ray diffraction carried out from the interface side for the galvannealing layer peeled off from the galvannealed steel sheet at the galvannealing/steel sheet interface preferably by a method described later in Examples:

$$I(\zeta:1.26)/I(\delta1:2.13) \leqq 0.01 \quad (8)$$

$$I(\Gamma:2.59)/I(\delta1:2.13) \leqq 0.05 \quad (9)$$

That is, the galvannealed steel sheet very excellent in powdering resistance and low coefficient of friction can be obtained by inhibiting the amounts of generated ζ-phase and Γ-phase within the above-mentioned ranges.

No particular limitation is imposed on the lower limits of I(ζ:1.26)/I(δ1:2.13), and I(Γ:2.59)/I(δ1:2.13)in the aforementioned equations (4) and (5) or (8) and (9) in the invention.

In the galvannealed steel sheet, as described above, Al in a necessary and sufficient amount must be contained in the galvannealing layer so that the Al content $X_{Al}$ (%) in the galvannealing layer and the coating weight W (g/m$^2$) of the galvannealed steel sheet substantially satisfy the following equation (1):

$$5 \leqq W \times (X_{Al} - 0.12) \leqq 15 \quad (1)$$

In the aforementioned galvannealed steel sheet of the invention, the iron content in the galvannealing layer should preferably be controlled within a range of from about 7 to about 12%.

The coating weight of the galvannealing layer should preferably be within a range of from about 10 to about 100 g/m$^2$.

The preferred method of making galvannealed steel sheet having excellent press workability comprises the step of, after the alloying treatment, subjecting the steel sheet to temper rolling with rolls having a surface roughness Ra value of at least 0.5 μm.

This invention creates a galvannealed steel sheet having excellent press workability, having a whiteness L-value as measured by the method specified in JIS Z 8722 (condition d, with light trap) of about 70 or less, and a glossiness as measured by the method specified in JIS Z 8741 (60° specular gloss method) of about 30 or less.

A more preferred embodiment relates to a galvannealed steel sheet having excellent press workability, having a whiteness L-value as measured by the method specified in JIS Z 8722 (condition d, with light trap) of about 70 or less, and a glossiness as measured by the method specified in JIS Z 8741 (60° specular gloss method) of about 30 or less, wherein the intensities of ζ-phase, δ1-phase and Γ-phase forms substantially satisfy the following equations (4) and (5) as observed through an X-ray diffraction applied from the interface side for the galvannealing layer peeled off from the galvannealed steel sheet at the galvannealing/steel sheet interface:

$$I(\zeta:1.26)/I(\delta1:2.13)\leqq 0.02 \quad (4)$$

$$I(\delta:2.59)/I(\delta1:2.13)\leqq 0.1 \quad (5)$$

where, I(ζ:1.26) represents intensity of the interplanar spacing d=1.26 Å of the ζ-phase; I(δ1:2.13), intensity of the interplanar spacing d=2.13 Å of the δ1-phase; and I(Γ:2,59) intensity of interplanar spacing d=2.59 Å of the Γ-phase.

A further preferred embodiment relates to a hot-dip galvannealed steel sheet having excellent press workability, having a whiteness L-value as measured by the method specified in JIS Z 8722 (condition d, with light trap) of about 70 or less, and a glossiness as measured by the method specified in JIS Z 8741 (60° specular gloss method) of about 30 or less; wherein the galvannealed steel sheet has a coating weight W within a range of from about 10 to about 100 g/m$^2$ and an iron content in the galvannealing layer within a range of from about 7 to about 12% (weight percentage), and an Al content $X_{Al}$ (%: weight percentage) and the coating weight W (g/m$^2$) substantially satisfy the following equation (1), and wherein the intensity of ζ-phase, δ1-phase and Γ-phase satisfies the following equations (4) and (5) as observed through X-ray diffraction applied from the interface side for the galvannealing layer peeled off from the galvannealed steel sheet at the galvannealing/steel sheet interface:

$$5\leqq W\times(X_{Al}-0.12)\leqq 15 \quad (1)$$

$$I(\zeta:1.26)/I(\delta1:2.13)\leqq 0.02 \quad (4)$$

$$I(\Gamma:2.59)/I(\delta1:2.13)\leqq 0.1 \quad (5)$$

where, I(ζ:1.26) represents the intensity of the interplanar spacing d=1.26 Å of the ζ-phase; I(δ1:2.13), intensity of the interplanar spacing d=2.13 Å of the δ1-phase; and I(Γ:2.59), intensity of interplanar spacing d=2.59 Å of the Γ-phase.

The Al content $X_{Al}$ and the iron content in the galvannealing layer in the above-mentioned preferred embodiments means the average Al content and the average iron content in the galvannealing layer.

As a result of extensive studies of the galvannealed steel sheet having excellent press workability, we obtained the following findings. It is possible to manufacture a galvannealed steel sheet having excellent press workability by temper-rolling the galvannealed steel sheet in which generation of ζ-phase and Γ-phase material is inhibited as much as possible obtained by the manufacturing method of a galvannealed steel sheet according to the invention, or preferably, by the use of rolls having a surface roughness Ra of at least about 0.5 μm.

Further, the galvannealed steel sheet obtained by the above-mentioned manufacturing method, having a whiteness L-value as measured by the method specified in JIS Z 8722 (condition d, with light trap) of about 70 or less, and a glossiness as measured by the method specified in JIS Z 8741 of about 30 or less was found to show very low coefficient of fraction.

The reason of the very low coefficient of friction of the above-mentioned galvannealed steel sheet is considered as follows.

A galvannealed steel sheet is usually subjected, after hot-dip galvanizing and heating-alloying, to temper rolling with a view to achieving desired mechanical properties. At this point, convex portions of the galvannealed layer surface are smoothly crushed, thus improving glossiness.

In this case, the portions crushed flat completely, which are associated with the increase in glossiness have a very low surface roughness. As a result, a lubricant cannot reach throughout the entire friction surface during press forming, thus tending to cause a defect known as a galling.

For portions crushed by temper rolling, but with an angle relative to the die, on the other hand, the lubricant oil never becomes short, hardly causing a galling.

As a result of various studies on the relationship between the defective frictional coefficient caused by the die galling as described above and properties of the galvannealing layer, we found a strong correlation between the are of portions crushed flat by temper rolling and glossiness.

More specifically, it becomes possible to maintain a satisfactory low coefficient of friction of the galvannealed steel sheet by setting a glossiness after temper rolling of about 30 or less.

The aforementioned galvannealed steel sheet having a glossiness of about 30 or less can be manufactured by satisfying the hot-dip galvanizing conditions, heating-alloying conditions, and conditions for the atmosphere gas in the process from the annealing furnace to the hot-dip galvanizing bath, and temper-rolling the steel sheet after alloying by the use of rolling rolls having a surface roughness Ra of at least 0.5 μm.

The reason is that, when temper-rolling the sheet with rolls having a low surface roughness Ra of under 0.5 μm, the crushed portions of the galvanizing becomes excessively flat, so that glossiness exceeds the range specified in the present invention, and the formed flat surface is not effective for galling resistance.

The rolling rolls used in temper rolling carried out after alloying should preferably have a surface roughness Ra of 2.0 μm or less.

When the rolling rolls have a surface roughness Ra of over 2.0 μm, there would be an increase in the surface roughness of the galvannealing layer, and the surface irregularities of the galvannealing layer cause deterioration of the property of friction upon press forming.

Further, we found that, even with the same glossiness, a difference in whiteness of the galvannealing layer surface causes a difference in coefficient of friction: a galvannealed steel sheet having a lower whiteness has a lower coefficient of friction.

The galvannealed steel sheet having a lower whiteness exhibits a lower coefficient of friction for the following reason.

More specifically, whiteness L-value is represented by the intensity of the reflected light diffused on the material surface, and this is defined as a value obtained by subtracting the positive reflected light (glossiness) and the light absorbed by the surface from the reflected light.

Irregularities comprising groups of crystal grains of intermetallic compounds forming the galvannealing surface layer are formed by alloying of the galvanizing layer on the galvannealed surface of the galvannealed steel sheet.

These fine irregularities are considered to have simultaneously a high light absorbing effect by forming these fine irregularities having the effect of effectively retaining oil upon sliding during pressing, through optimization of the hot-dip galvanizing conditions and the heating-alloying conditions.

Therefore, with the same glossiness, a galvannealed layer having a higher light absorbing effect, i.e., having a lower whiteness, is considered to show a satisfactory low coefficient of friction under the effect of fine irregularities retaining lubricant oil upon sliding during press working.

According to the present invention, a satisfactory low coefficient of friction is available by adopting a whiteness L-value of about 70 or less of the galvannealed steel sheet.

The aforementioned galvannealed steel sheet having a whiteness: an L-value of about 70 or less, i.e., having fine irregularities favorable for lower coefficient of friction is available only by the manufacturing method of the invention.

The aforementioned further preferred embodiment of the invention relates to a galvannealed steel sheet having excellent press workability, wherein whiteness L-value as measured by the method specified in JIS Z 8722 (condition d, with light trap) is about 70 or less, and glossiness as measured by the method specified in JIS Z 8741 (60° specular gloss method) is about 30 or less, and wherein intensity of ζ-phase, δ1-phase and Γ-phase substantially satisfies the following equations (4) and (5) as observed through an X-ray diffraction applied from the interface side for the galvannealing layer peeled off from the galvannealed steel sheet at the galvannealing/steel sheet interface:

$$I(\zeta:1.26)/I(\delta1:2.13)\leqq 0.02 \quad (4)$$

$$I(\Gamma:2.59)/I(\delta1:2.13)\leqq 0.1 \quad (5)$$

where, I(ζ:1.26) represents the intensity of the interplanar spacing d=1.26 Å of the ζ-phase; I(δ1:2.13), represents the intensity of the interplanar spacing d=2.13 Å of the δ1-phase; and I(Γ:2.59) represents the intensity of the interplanar spacing d=2.59 Å of the Γ-phase.

The further preferred embodiment relates to a galvannealed steel sheet having excellent press workability, having a whiteness L-value as measured by the method specified in JIS Z 8722 (condition d, with light trap) of about 70 or less, and a glossiness as measured by the method specified in JIS Z 8741 (60° specular gloss method) of about 30 or less; wherein the galvannealed steel sheet has a coating weight W within a range of from about 10 to 100 g/m$^2$ and an iron content in the galvannealing layer within a range of from about 7 to 12% (weight percentage), and the Al content $X_{Al}$ (%: weight percentage) and the coating weight W (g/m$^2$) substantially satisfy the following equation (1); and wherein the intensity of the ζ-phase, the δ1-phase and the Γ-phase substantially satisfies the following equations (4) and (5) as observed through X-ray diffraction applied from the interface side for the galvannealing layer peeled off from the galvannealed steel sheet at the galvannealing/steel sheet interface:

$$5\leqq W\times(X_{1Al}-0.12)\leqq 15 \quad (1)$$

$$I(\zeta:1.26)/I(\delta1:2.13)\leqq 0.02 \quad (4)$$

$$I(\Gamma:2.59)/I(\delta1:2.13)\leqq 0.1 \quad (5)$$

where, I(ζ:1.26) represents the intensity of the interplanar spacing d=1.26 Å of the ζ-phase; I(δ1:2.13), intensity of the interplanar spacing d=2.13 Å of the δ1-phase; and I(Γ:2.59), intensity of the interplanar spacing d=2.59 Å of the Γ-phase.

According to the invention, as described above, a very low coefficient of friction is available by temper-rolling the galvannealed steel sheet in which generation of the ζ-phase and the Γ-phase is inhibited as much as possible, manufactured by the manufacturing method of the invention, by the use of rolls having a surface roughness Ra of at least about 0.5 μm, and using a whiteness L-value of about 70 or less and a glossiness of about 30 or less of the galvannealed steel sheet.

While no particular limitation is imposed on the lower limit value of whiteness L-value and glossiness of the galvannealed steel sheet, whiteness should preferably be at least about 30 and glossiness, at least about 1.

Both in the case with a whiteness L-value of under about 30 and in the case with a glossiness of under about 1, excessive surface irregularities may cause deterioration of the property of friction during press forming.

The present invention has been described above. Notwithstanding the above, no particular limitation is imposed on the kind of steel sheet serving as a material for galvanizing.

Practically, applicable steel sheets serving as materials for the galvannealed steel sheet include Ti, Nb, and Ti-Nb extra-low carbon IF steel sheet, low-carbon steel sheet and high-strength steel sheet containing enforcing elements such as P, Mn or Si, popularly used as automotive rust-preventive steel sheets.

The galvannealing layer of the galvannealed steel sheet of the invention may comprise not only a single layer of Zn—Fe alloy, but also a two-layer coating formed by applying iron-based electrogalvanizing on the molten zinc galvannealing layer, or a multi-layer coating having a surface layer of a material other than iron-based one. The galvannealed steel sheets of the invention include a galvannealed steel sheet, and a steel sheet formed by subjecting a single layer galvannealed steel sheet and/or a multi-layer galvannealed steel sheet to a chemical treatment such as chromating or phosphating.

The galvannealing layer of the galvannealed steel sheet of the invention may contain, apart from Fe and Al, constituents of steel serving as a material such as Mn, P, Si, Ti, Nb, C, S and B.

EXAMPLES

The present invention will now be described in detail by means of examples.

Example 1 Examples of the Invention 1–12, and Comparative Examples 1–10)

A Ti—Nb extra-low carbon mild cold-rolled steel sheet not annealed having the composition shown in Table 1 was used as a material. Hot-dip galvanizing, a heating-alloying treatment and temper rolling were applied under the following conditions on a continuous hot-dip galvanizing line of a commercial production line (all-radiant tube type CGL):

[Line speed]

120 mpm

[Annealing conditions]

Atmosphere gas composition in annealing furnace: 5 vol. % $H_2$—$N_2$

Dew point of the atmosphere gas in annealing furnace: Shown in Table 2

Annealing temperature: 800° C.

Annealing period: 20 seconds

[Atmosphere gas in steel sheet passing section in the process from annealing furnace to galvanizing bath]

Atmosphere gas composition: 5 vol. % $H_2$—$N_2$

Dew point of atmosphere gas, oxygen concentration in atmosphere gas: Shown in Table 2

The above-mentioned atmosphere gas composition and the dew point of the atmosphere gas represent average values of the atmosphere gas in the steel sheet passing section in the process from annealing furnace exit to the snout entry and the atmosphere gas in the snout.

[Hot-dip galvanizing conditions]

The total Al concentration of the galvanizing bath, total Fe concentration of the galvanizing bath, bath temperature, and incoming sheet temperature into the galvanizing bath: Shown in Table 2.

The total Al concentration of the galvanizing bath and the total Fe concentration of the galvanizing bath were determined by sampling the molten zinc from a depth of at least 500 mm from the bath surface as bath samples, causing solidification of samples by the water rapid cooling method, heating and melting the resultant samples with 35 vol. % nitric acid, and analyzing the Al concentration and the Fe concentration through atomic absorption spectrochemical analysis.

[Alloying conditions]

Heating rate from end of gas wiping to the maximum sheet temperature, and maximum sheet temperature: Shown in Table 2.

[Temper rolling conditions]

Work roll surface roughness of temper rolling mill:

Ra=0.8 $\mu$m (JIS B 0601-1994, arithmetic mean roughness)

Then, various properties of the galvannealing layer of the galvannealed steel sheet thus obtained, and performance of the galvannealed steel sheet were tested and evaluated by the following test method and evaluation method:

[Coating weight: W of hot-dip galvannealed steel sheet, and iron content, Al content: $X_{Al}$ and $W\times(X_{Al}-0.12)$ of galvannealing layer]

The galvannealing layer of the galvannealed steel sheet obtained under the above-mentioned conditions was dissolved in hydrochloric acid containing an inhibitor, and analyzed by means of an ICP (induction-coupled plasma emission spectroanalyzer).

The coating weight W of the galvannealed steel sheet, and the average iron content the average Al content $X_{Al}$ and $W\times(X_{Al}-0.12)$ in the galvannealing layer are shown in Table 3.

The phase structure of the resultant galvannealing layer was investigated by the following method:

First, a galvannealed steel sheet sample after degreasing was cut into a width of 25 mm and a length of 100 mm, was bonded to a cold-rolled steel sheet having the same size with a bonding area of 25 mm×13 mm and an adhesive thickness of 1.5 mm, and baked under conditions of 170° C.×30 minutes.

Then, the resulting test piece was pulled at a speed of 50 mm/minute by the use of an instron-type tensile tester to peel off the galvannealing layer from the galvanized steel sheet interface.

The cold-rolled sheet sample having the peeled galvannealing layer adhering thereto was stamped into a size having a diameter of 15 mm, and the resulting piece was used as a sample for X-ray diffraction.

Then, X-ray diffraction was carried out for the peeled galvannealing layer from the galvannealed steel sheet interface, under the following conditions:

(X-ray diffraction conditions)

θ−2θ method

X-ray tube bulb: Cu

Tube voltage: 50 kV

Tube current: 250 mA

On the basis of the result of X-ray diffraction, the ratio {I(ζ:1.26)/I(δ1:2.13)} was determined.

I(ζ:1.26) represents the intensity of interplanar spacing d=1.26 Å of the ζ-phase; and I(δ1:2.13) represents the intensity of interplanar spacing d=2.13 Å of the δ1-phase.

The result obtained is shown in Table 3.

Similarly, the ratio {I(Γ:2.59)/I(δ1:2.13)} was determined from the value of (Γ:2.59) and the value of I(δ1:2.13).

I(Γ:2.59) represents the intensity of interplanar spacing d=2.59 Å of the Γ-phase.

The result obtained is shown in Table 3.

As performance tests of the galvannealing layer of the resultant galvannealed steel sheet, the following powdering resistance test and friction test were made.

Test pieces of galvannealed steel sheet having widths of 40 mm and lengths of 100 mm were used.

90° bending/straightening (using a jig of 1R)→tape peeling→fluorescent X-ray analysis of tape surface; the number of counts measured by fluorescent X-ray analysis was used as an indication of the amount of peel.

The number of counts (CPS) obtained referred to as the powdering index, is shown in Table 3.

To conduct the friction test, a test piece of galvannealed steel sheet with a width of 20 mm and a length of 200 mm was used.

Figure 2:
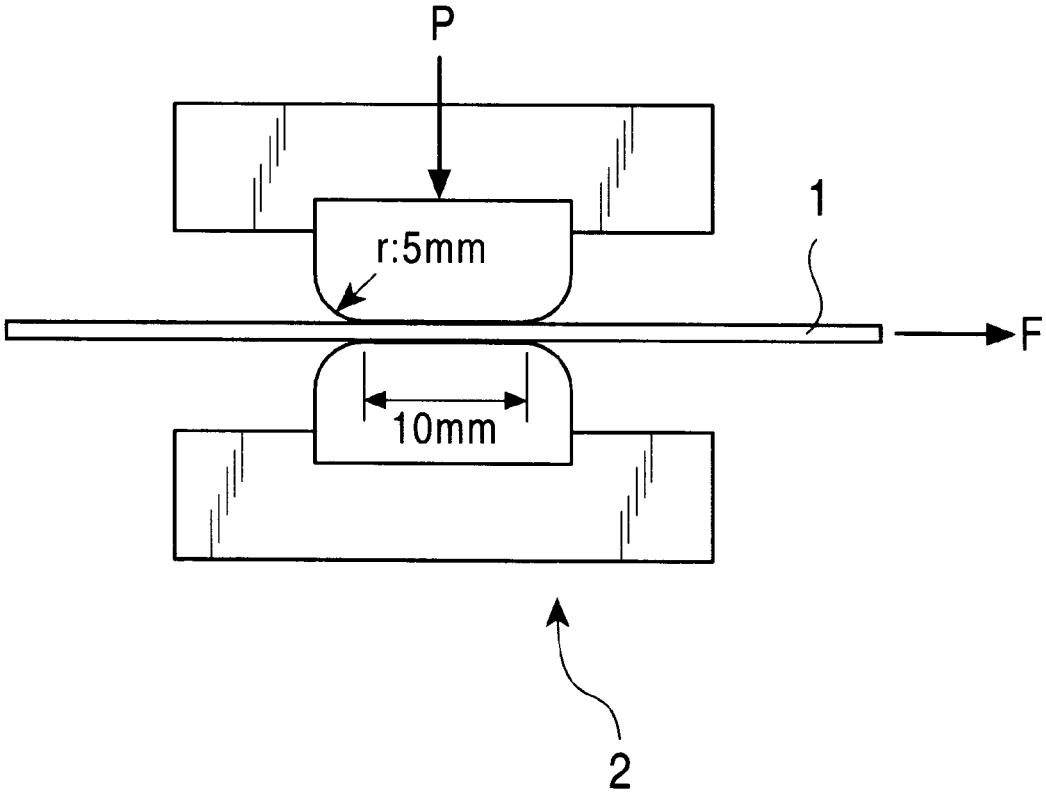
FIG. 2 is a descriptive view (longitudinal sectional view) illustrating a friction test method.

The die was a flat die (shown in FIG. 2; In FIG. 2, the number 1 represents the test piece of galvannealed steel sheet, the number 2 represents the die, F represents the pulling force, P represents the pressing pressure, and r represents the radius of curvature.

Contact area between test piece and die: 10 mm×20 mm

Pressing pressure (P): 1962 N

Sliding speed: 20 mm/second

Lubricant condition: Washing oil R303P applied

The pulling force (F) (in units of N) in the test carried out under these conditions was measured, and slidability was evaluated by means of the coefficient of friction derived from the following equation (10).

$$V=F/2P \tag{10}$$

The values of p coefficient of friction are shown in Table 3.

As shown in Tables 2 and 3, it is known that the galvannealed steel sheet obtained had excellent press formability. It was made under conditions (1) the relationship between the total Al concentration and the total Fe concentration of the galvanizing bath was $N_{Al}-N_{Fe}$, (2) the relationship between the incoming sheet temperature into the galvanizing bath and the bath temperature was t−T, (3) the Al was maintained in a prescribed amount in the galvanizing bath for the galvannealed steel sheet by setting forth the oxygen concentration and the dew point for the atmosphere gas in the annealing furnace and in the steel sheet passing section in the process from the annealing furnace to the galvanizing bath, and alloying the sheet by conducting alloying with a prescribed (4) heating rate to the maximum sheet temperature, and (5) at the maximum sheet temperature. Generation of ζ-phase and Γ-phase was strongly inhibited.

TABLE 1

| C | Si | Mn | P | S | Al | Ti | Nb |
|---|---|---|---|---|---|---|---|
| 0.002 | 0.03 | 0.05 | 0.01 | 0.005 | 0.035 | 0.03 | 0.003 |

[Unit of figures in table: % (mass percentage)]

TABLE 2

| | Atmosphere gas in annealing furnace | | Atmosphere gas after annealing furnace* | | Hot-dip galvannealing bath | | | | | | Galvannealing conditions | |
|---|---|---|---|---|---|---|---|---|---|---|---|---|
| | Dew point (° C.) | Oxygen concentration (vol. ppm) | Dew point (° C.) | Oxygen concentration (vol. ppm) | Total Al concentration: NA1(%) | Total Fe concentration: NFe(%) | NA1-NFe (%) | Bath temperature: T (° C.) | Incoming sheet temperature: t (° C.) | t-T (° C.) | Heating rate** (° C./s) | Maximum reachable sheet temperature (° C.) |
| Example of | −30 | 10 | −35 | 15 | 0.145 | 0.050 | 0.095 | 465 | 475 | 10 | 25 | 490 |
| Example of | −35 | 8 | −32 | 12 | 0.145 | 0.045 | 0.100 | 465 | 480 | 15 | 30 | 520 |
| Example of | −30 | 10 | −35 | 15 | 0.145 | 0.050 | 0.095 | 465 | 475 | 10 | 20 | 471 |
| Example of | −35 | 8 | −32 | 12 | 0.145 | 0.045 | 0.100 | 465 | 480 | 15 | 11 | 500 |
| Example of | −35 | 8 | −32 | 12 | 0.145 | 0.045 | 0.100 | 465 | 465 | 0 | 25 | 492 |
| Example of | −30 | 10 | −35 | 15 | 0.145 | 0.050 | 0.095 | 465 | 505 | 40 | 25 | 490 |
| Example of | −30 | 10 | −35 | 15 | 0.155 | 0.045 | 0.110 | 465 | 475 | 10 | 25 | 490 |
| Example of | −30 | 10 | −35 | 15 | 0.130 | 0.045 | 0.095 | 465 | 475 | 10 | 25 | 490 |
| Example of | −30 | 10 | −35 | 35 | 0.145 | 0.050 | 0.095 | 465 | 475 | 10 | 25 | 490 |
| Example of | −30 | 10 | −20 | 15 | 0.145 | 0.050 | 0.095 | 465 | 475 | 10 | 25 | 490 |
| Example of | −30 | 25 | −35 | 15 | 0.145 | 0.050 | 0.095 | 465 | 475 | 10 | 25 | 490 |
| Example of | −22 | 10 | −35 | 15 | 0.145 | 0.050 | 0.095 | 465 | 475 | 10 | 25 | 490 |
| Comparative | −35 | 8 | −32 | 12 | 0.145 | 0.045 | 0.100 | 465 | 480 | 15 | 30 | 560 |
| Comparative | −30 | 10 | −35 | 15 | 0.145 | 0.050 | 0.095 | 465 | 475 | 10 | 20 | 456 |
| Comparative | −35 | 8 | −32 | 12 | 0.145 | 0.045 | 0.100 | 465 | 480 | 15 | 8 | 500 |
| Comparative | −30 | 8 | −32 | 12 | 0.145 | 0.045 | 0.100 | 470 | 465 | −5 | 25 | 492 |
| Comparative | −30 | 10 | −35 | 15 | 0.165 | 0.04 | 0.125 | 465 | 475 | 10 | 25 | 490 |
| Comparative | −30 | 10 | −35 | 15 | 0.120 | 0.045 | 0.075 | 465 | 475 | 10 | 25 | 490 |
| Comparative | −30 | 10 | −35 | 60 | 0.145 | 0.050 | 0.095 | 465 | 475 | 10 | 25 | 490 |
| Comparative | −30 | 10 | −5 | 15 | 0.145 | 0.050 | 0.095 | 465 | 475 | 10 | 25 | 490 |
| Comparative | −30 | 55 | −35 | 15 | 0.145 | 0.050 | 0.095 | 465 | 475 | 10 | 25 | 490 |
| Comparative | −10 | 10 | −35 | 15 | 0.145 | 0.050 | 0.095 | 465 | 475 | 10 | 25 | 490 |

Note)
*: Atmosphere gas in steel sheet threading section from annealing furnace to galvanizing bath level [% in table represents mass percentage]
**: Heating rate up to maximum reachable sheet temperature

TABLE 3

| | Hot-dip galvannealing layer | | | | | | | |
|---|---|---|---|---|---|---|---|---|
| | Coating weight: W (g/m$^2$) | Iron content (%) | Al content: XA1 | W × (XA1 − 0.12) | I(ζ: 1.26)/I($\delta_1$: 2.13) | I(Γ: 2.59)/I($\delta_1$: 2.13) | Powdering index (CPS) | Coefficient of friction: $\mu$ |
| Example of Invention 1 | 55.0 | 10.0 | 0.25 | 7.2 | 0.004 | 0.04 | 2000 | 0.110 |
| Example of Invention 2 | 50.0 | 9.5 | 0.28 | 8.2 | 0.004 | 0.05 | 2500 | 0.105 |
| Example of Invention 3 | 62.0 | 9.3 | 0.24 | 7.5 | 0.010 | 0.03 | 1800 | 0.115 |
| Example of Invention 4 | 45.0 | 10.5 | 0.27 | 6.6 | 0.009 | 0.05 | 2200 | 0.112 |
| Example of Invention 5 | 48.0 | 10.5 | 0.24 | 5.8 | 0.004 | 0.04 | 2000 | 0.110 |
| Example of Invention 6 | 34.0 | 11.0 | 0.46 | 11.5 | 0.003 | 0.04 | 2100 | 0.108 |
| Example of Invention 7 | 42.0 | 11.2 | 0.42 | 12.8 | 0.005 | 0.06 | 1900 | 0.102 |
| Example of Invention 8 | 53.0 | 10.3 | 0.22 | 5.4 | 0.010 | 0.05 | 2100 | 0.108 |

TABLE 3-continued

| | Hot-dip galvannealing layer | | | | | | | |
|---|---|---|---|---|---|---|---|---|
| | Coating weight: W (g/m$^2$) | Iron content (%) | Al content: XA1 | W × (XA1 − 0.12) | I(ζ: 1.26)/ I($\delta_1$: 2.13) | I(Γ: 2.59)/ I($\delta_1$: 2.13) | Powdering index (CPS) | Coefficient of friction: $\mu$ |
| Example of Invention 9 | 55.0 | 10.0 | 0.24 | 6.5 | 0.004 | 0.05 | 2100 | 0.110 |
| Example of Invention 10 | 50.0 | 9.5 | 0.24 | 5.8 | 0.005 | 0.05 | 2500 | 0.106 |
| Example of Invention 11 | 62.0 | 9.3 | 0.23 | 7.0 | 0.012 | 0.05 | 1900 | 0.117 |
| Example of Invention 12 | 45.0 | 10.5 | 0.24 | 5.5 | 0.010 | 0.06 | 2400 | 0.114 |
| Comparative Example 1 | 55.0 | 10.0 | 0.25 | 7.2 | 0.004 | 0.12 | 4000 | 0.110 |
| Comparative Example 2 | 50.0 | 9.5 | 0.28 | 8.2 | 0.021 | 0.08 | 2500 | 0.137 |
| Comparative Example 3 | 62.0 | 9.3 | 0.24 | 7.5 | 0.021 | 0.11 | 6800 | 0.135 |
| Comparative Example 4 | 45.0 | 10.5 | 0.22 | 4.5 | 0.022 | 0.12 | 4100 | 0.136 |
| Comparative Example 5 | 48.0 | 10.0 | 0.24 | 5.8 | 0.021 | 0.13 | 4200 | 0.132 |
| Comparative Example 6 | 34.0 | 11.0 | 0.46 | 11.5 | 0.032 | 0.20 | 4500 | 0.138 |
| Comparative Example 7 | 42.0 | 11.2 | 0.22 | 4.2 | 0.022 | 0.15 | 4500 | 0.132 |
| Comparative Example 8 | 53.0 | 10.3 | 0.21 | 4.8 | 0.022 | 0.12 | 4200 | 0.133 |
| Comparative Example 9 | 55.0 | 10.0 | 0.18 | 3.5 | 0.032 | 0.22 | 5100 | 0.136 |
| Comparative Example 10 | 50.0 | 9.5 | 0.21 | 4.5 | 0.023 | 0.15 | 4900 | 0.138 |

[% in table represents a mass percentage]

Example 2 Examples of the Invention 13–21, Comparative Examples 11–17)

A cold-rolled material not annealed of a Ti—Nb extra-low carbon mild steel sheet having a chemical composition shown in Table 1 was used as the material. Hot-dip galvanizing, a heating-alloying treatment and temper rolling were applied to the material under the following conditions on a continuous molten zinc galvanizing line (all radiant tube type CGL) of a commercial production line.

[Line speed]

120 mpm

[Annealing conditions]

Atmosphere gas composition in annealing furnace: 5 vol. % $H_2$—$N_2$

Dew point of atmosphere gas in annealing furnace, and oxygen concentration in atmosphere gas: Shown in Table 4

Annealing temperature: 800° C.

Annealing period: 20 seconds

[Atmosphere gas in steel sheet passing section in the process from annealing furnace to galvanizing bath]

Atmosphere gas composition: 5 vol. % $H_2$—$N_2$

Dew point of atmosphere gas, oxygen concentration in atmosphere gas: Shown in Table 4

The above-mentioned atmosphere gas composition and the dew point of the atmosphere gas are average values for the atmosphere gas in the steel sheet passing section in the process from the annealing furnace exit to the snout entry and the atmosphere gas in the snout.

[Hot-dip galvanizing conditions]

Total Al concentration in galvanizing bath, total Fe concentration in galvanizing bath, bath temperature and incoming sheet temperature into galvanizing bath are shown in Table 4.

The total Al concentration in the galvanizing bath and the total Fe concentration in the galvanizing bath were determined, as in Example 1 above, by sampling molten zinc from a depth of at least 500 mm from the galvanizing bath surface as bath samples, causing solidification by the water rapid cooling method, heating and melting the resultant sample with 35 vol. % nitric acid, and analyzing the Al concentration and the Fe concentration through atomic absorption spectrochemical analysis.

[Alloying conditions]

Heating rate after completion of gas wiping to the maximum sheet temperature, and the maximum sheet temperature: Shown in Table 4.

[Temper rolling conditions]

Work roll surface roughness of temper rolling mill: Ra (JIS B 0601-1994, arithmetic mean roughness): Shown in Table 4.

Various properties of the galvannealing layer of the galvannealed steel sheet obtained under these conditions, and performance of the galvannealed steel sheet were tested and evaluated by the same test method and method of evaluation as in Example 1.

Whiteness: L-value and glossiness of the galvanized surface of the galvannealed steel sheet were measured by the following test method:

[Whiteness, L-value]

JIS Z 8722-1994 (condition d, with light trap)

[Glossiness]

JIS Z 8741-1983 (60° specular gloss method)

Various properties of the galvannealing layer of the resultant galvannealed steel sheet and the performance of the galvannealed steel sheet are shown in Table 5.

As shown in Table 5, the galvannealed steel sheet having a whiteness: L-value of 70 or less and a glossiness of 30 or less, obtained by the method of the invention has an decreased coefficient of friction, and is excellent in press workability.

TABLE 4

| | Atmosphere gas in annealing furnace | | Atmosphere gas after annealing furnace* | | Hot-dip galvannealing bath | | | | | | Galvannealing conditions | | Roll surface |
|---|---|---|---|---|---|---|---|---|---|---|---|---|---|
| | Dew point (° C.) | Oxygen concentration (vol. ppm) | Dew point (° C.) | Oxygen concentration (vol. ppm) | Total Al concentration: NA1(%) | Total Fe concentration: NFe(%) | NA1-NFe (%) | Bath temperature: T(° C.) | Incoming sheet temperature: t (° C.) | t-T (° C.) | Heating rate** (° C./s) | Maximum reachable sheet temperature (° C.) | roughness of temper rolling mill: Ra (μm) |
| Example of | −30 | 10 | −35 | 15 | 0.145 | 0.050 | 0.09 | 465 | 480 | 15 | 25 | 490 | 1.4 |
| Example of | −35 | 8 | −32 | 12 | 0.145 | 0.045 | 0.10 | 460 | 480 | 20 | 30 | 520 | 1.0 |
| Example of | −30 | 10 | −35 | 15 | 0.145 | 0.050 | 0.09 | 470 | 475 | 5 | 20 | 471 | 0.8 |
| Example of | −35 | 8 | −32 | 12 | 0.145 | 0.045 | 0.10 | 475 | 490 | 15 | 11 | 500 | 0.6 |
| Example of | −35 | 8 | −32 | 12 | 0.145 | 0.042 | 0.10 | 465 | 465 | 0 | 25 | 492 | 1.1 |
| Example of | −30 | 10 | −35 | 15 | 0.145 | 0.050 | 0.09 | 465 | 505 | 40 | 25 | 540 | 0.9 |
| Example of | −30 | 10 | −35 | 15 | 0.155 | 0.045 | 0.11 | 465 | 475 | 10 | 25 | 535 | 0.7 |
| Example of | −30 | 10 | −35 | 15 | 0.130 | 0.045 | 0.08 | 465 | 475 | 10 | 25 | 525 | 1.2 |
| Example of | −30 | 10 | −35 | 35 | 0.145 | 0.050 | 0.09 | 465 | 475 | 10 | 25 | 500 | 1.5 |
| Comparative | −35 | 8 | −32 | 12 | 0.145 | 0.045 | 0.10 | 465 | 480 | 15 | 30 | 455 | 1.1 |
| Comparative | −30 | 10 | −35 | 15 | 0.145 | 0.050 | 0.09 | 465 | 475 | 10 | 20 | 460 | 1.0 |
| Comparative | −35 | 8 | −32 | 12 | 0.145 | 0.045 | 0.10 | 465 | 480 | 15 | 8 | 500 | 0.8 |
| Comparative | −35 | 8 | −32 | 12 | 0.145 | 0.045 | 0.10 | 470 | 465 | −5 | 25 | 492 | 1.2 |
| Comparative | −30 | 10 | −35 | 15 | 0.120 | 0.045 | 0.07 | 465 | 475 | 10 | 25 | 490 | 0.4 |
| Comparative | −30 | 10 | −35 | 10 | 0.145 | 0.050 | 0.09 | 465 | 475 | 10 | 25 | 490 | 0.2 |
| Comparative | −30 | 10 | −35 | 15 | 0.145 | 0.050 | 0.09 | 465 | 475 | 10 | 25 | 490 | 0.3 |

Note)

*: Atmosphere gas in steel sheet threading section from annealing furnace to galvanizing bath level [% in table represents a mass percentage]

**: Heating rate up to maximum reachable sheet temperature

TABLE 5

| | Hot-dip galvannealing layer | | | | | | | | | |
|---|---|---|---|---|---|---|---|---|---|---|
| | Coating weight: W ($g/m^2$) | Iron content (%) | Al content: XA1(%) | W × (XA1 − 0.12) | I(ζ: 1.26)/I($\delta_1$: 2.13) | I(Γ: 2.59)/I($\delta_1$: 2.13) | Whiteness (L-value) | Glossiness | Powdering index (CPS) | Coefficient of friction: μ |
| Example of Invention 13 | 54.0 | 9.0 | 0.38 | 14.0 | 0.002 | 0.02 | 62 | 11 | 2100 | 0.101 |
| Example of Invention 14 | 49.0 | 10.0 | 0.23 | 5.4 | 0.010 | 0.06 | 65 | 15 | 2400 | 0.098 |
| Example of Invention 15 | 63.0 | 11.0 | 0.26 | 8.8 | 0.009 | 0.06 | 67 | 18 | 1900 | 0.103 |
| Example of Invention 16 | 44.0 | 10.5 | 0.32 | 8.8 | 0.005 | 0.05 | 61 | 26 | 2100 | 0.102 |
| Example of Invention 17 | 50.0 | 9.5 | 0.35 | 11.5 | 0.004 | 0.03 | 68 | 13 | 2100 | 0.105 |
| Example of Invention 18 | 32.0 | 8.5 | 0.28 | 5.1 | 0.007 | 0.03 | 63 | 19 | 2800 | 0.100 |
| Example of Invention 19 | 45.0 | 8.2 | 0.32 | 9.0 | 0.006 | 0.02 | 66 | 22 | 2600 | 0.101 |
| Example of Invention 20 | 54.0 | 10.5 | 0.25 | 7.0 | 0.008 | 0.07 | 64 | 14 | 2200 | 0.104 |
| Example of Invention 21 | 69.0 | 10.0 | 0.30 | 12.4 | 0.003 | 0.03 | 60 | 10 | 2000 | 0.099 |
| Comparative Example 11 | 60.0 | 8.6 | 0.15 | 1.8 | 0.030 | 0.05 | 75 | 16 | 2400 | 0.146 |
| Comparative Example 12 | 55.0 | 9.0 | 0.18 | 3.3 | 0.025 | 0.04 | 77 | 14 | 2100 | 0.138 |
| Comparative Example 13 | 43.0 | 10.0 | 0.20 | 3.4 | 0.028 | 0.03 | 73 | 18 | 2300 | 0.144 |
| Comparative Example 14 | 58.0 | 9.2 | 0.17 | 2.9 | 0.035 | 0.06 | 71 | 11 | 1800 | 0.141 |
| Comparative Example 15 | 48.0 | 10.6 | 0.20 | 3.8 | 0.026 | 0.05 | 63 | 45 | 2400 | 0.139 |

TABLE 5-continued

| | Hot-dip galvannealing layer | | | | | | | | | |
|---|---|---|---|---|---|---|---|---|---|---|
| | Coating weight: W ($g/m^2$) | Iron content (%) | Al content: XA1(%) | W × (XA1 − 0.12) | I(ζ: 1.26)/ I($\delta_1$: 2.13) | I(Γ: 2.59)/ I($\delta_1$: 2.13) | Whiteness (L-value) | Glossiness | Powdering index (CPS) | Coefficient of friction: $\mu$ |
| Comparative Example 16 | 40.0 | 11.5 | 0.22 | 4.0 | 0.030 | 0.15 | 62 | 60 | 1800 | 0.137 |
| Comparative Example 17 | 43.0 | 13.0 | 0.32 | 8.6 | 0.028 | 0.28 | 67 | 51 | 2100 | 0.146 |

[% in table represents a mass percentage]

According to the present invention, generation of the ζ-phase and the Γ-phase is well inhibited-and a galvannealed steel sheet having very excellent press workability can be provided only by maintaining Al in a controlled amount in the galvannealing layer and rapidly heating to a prescribed maximum sheet temperature. Also according to the invention, a galvannealed steel sheet having very excellent press workability can be provided by limiting the whiteness L-value and glossiness of the galvannealing surface of the galvannealed steel sheet within specific ranges.

What is claimed is:

1. A method of manufacturing a galvannealed steel sheet, comprising the steps of:

applying hot-dip galvanizing to a steel sheet;

subjecting said steel sheet to gas wiping for control of the coating weight;

heating said steel sheet at a heating rate of at least about 10 ° C./second to a maximum sheet temperature within a range of from about 470 to 550° C.;

galvannealing said sheet at a temperature of the maximum sheet temperature or less, thereby obtaining a Zn—Fe galvannealing layer having an Al content $X_{Al}$ (wt %) of the galvannealing layer and the coating weight of said galvannealed steel sheet w ($g/m^2$) substantially satisfying the following equation (1), $$5 \leqq W \times (X_{Al} - 0.12) \leqq 15 \quad (1)$$

maintaining an iron content in said galvannealing layer within the range of from about 7 to 12 wt %;

wherein the total Al concentration $N_{Al}$(wt %) and the total iron concentration $N_{fe}$(wt %) in the galvanizing bath upon hot-dip galvanizing substantially satisfy the following equation (2), and the incoming sheet temperature into the galvanizing bath t° C. and the galvanizing bath temperature T° C. satisfy the following equation (3):

$$0.08 \leqq N_{al} - N_{fe} \leqq 0.12 \quad (2)$$

$$0 \leqq t - T \leqq 50 \quad (3).$$

2. A method of manufacturing a galvannealed steel sheet according to claim 1, wherein said steel sheet is passed through a passing section extending from an annealing furnace to a galvanizing bath, and wherein the atmosphere gas in said steel sheet passing section has an oxygen concentration of about 50 vol.ppm or less and a dew point of about −20° C. or less.

3. A method of manufacturing a galvannealed steel sheet according to claim 1, wherein, after the galvannealing treatment, temper rolling is carried out with rolls having a surface roughness $R_a$ of at least 0.5 $\mu$m.

4. A galvannealed steel sheet produced according to the process of claim 1 comprising a galvannealing layer which may be peeled off at a galvannealing/steel sheet interface, said galvannealed layer having intensities of ζ-phase, $\delta_1$ phase and Γ-phase, observed through X-ray diffraction from said interface, substantially satisfying the following equations (4) and (5):

$$I(\zeta:1.26)/I(\delta_1:2.13) \leqq 0.02 \quad (4)$$

$$I(\Gamma:2.59)/I(\delta_1:2.13) \leqq 0.1 \quad (5)$$

where, I(ζ:1.26) is the intensity of said ζ phase, interplanar spacing d=1.26 Å; I($\delta_1$:2.13) is the intensity of said $\delta_1$-phase, interplanar spacing d=2.13 Å; and I(Γ:2.59) is the intensity of Γ-phase, interplanar spacing d=2.59 Å.

5. A galvannealed steel sheet according to claim 4, wherein said galvannealed steel sheet has a coating weight w within a range of from about 10 to 100 $g/m^2$, an iron content in the galvannealing layer within the range of from about 7 to 12 wt %, an Al content in the galvannealing layer $X_{al}$ (wt %) and a coating weight w ($g/m^2$) substantially satisfying the following equation (1):

$$5 \leqq w \times (X_{al} - 0.12) \leqq 15 \quad (1).$$

6. A galvannealed steel sheet produced according to the process of claim 1, wherein said galvannealed steel sheet has a whiteness L-value as measured by the method specified in JIS Z8722 condition d, with light trap, of about 70 or less, and wherein said galvannealed steel sheet has a glossiness as measured by the method specified in JIS Z8741, 60° specular gloss method, of about 30 or less.

* * * * *

UNITED STATES PATENT AND TRADEMARK OFFICE

CERTIFICATE OF CORRECTION

PATENT NO. : 6,368,728 B1
DATED : April 9, 2002
INVENTOR(S) : Tobiyama et al.

It is certified that error appears in the above-identified patent and that said Letters Patent is hereby corrected as shown below:

Column 19,
Table 2, at the subheading "NA1-NFe (%)", at row 8, please change "0.095" to -- 0.085 --.

Signed and Sealed this

Twenty-ninth Day of October, 2002

*Attest:*

*Attesting Officer*

JAMES E. ROGAN
*Director of the United States Patent and Trademark Office*